US005286228A

United States Patent [19]

Lee et al.

[11] Patent Number: 5,286,228

[45] Date of Patent: Feb. 15, 1994

[54] TOY MECHANICAL HAND

[75] Inventors: James S. W. Lee, Long Island, N.Y.; Chiu K. Kwan, Hunghom, Hong Kong

[73] Assignee: C. J. Associates, Ltd., Monrovia, Liechtenstein

[21] Appl. No.: 980,929

[22] Filed: Nov. 23, 1992

[51] Int. Cl.[5] ..... A63H 33/00; A63H 3/36

[52] U.S. Cl. ..... 446/26; 446/390; 446/487; 623/63; 623/64; 294/106; 414/1

[58] Field of Search ..... 446/26, 31, 144, 327, 446/382, 390, 486, 487, 901; 623/63, 64, 65; 294/106, 115; 414/1, 2, 8

[56] References Cited

U.S. PATENT DOCUMENTS

| | | | |
|---|---|---|---|
| 2,435,614 | 2/1948 | Tureman, Jr. | 623/63 X |
| 3,188,753 | 6/1965 | Lovercheck | 623/64 X |
| 3,453,774 | 7/1969 | Breneman et al. | 446/26 X |
| 3,953,935 | 5/1976 | Reiner et al. | 446/26 |
| 4,315,650 | 2/1982 | Yoshida | 446/390 X |
| 4,466,649 | 8/1984 | Ozawa | 623/64 X |
| 4,685,924 | 8/1987 | Massey | 623/63 |
| 4,768,681 | 9/1988 | Dean et al. | 446/26 X |
| 4,820,229 | 4/1989 | Spraggins | 446/26 |
| 4,903,864 | 2/1990 | Sirhan | 446/26 X |

*Primary Examiner*—David N. Muir

*Attorney, Agent, or Firm*—Laff, Whitesel, Conte & Saret

[57] ABSTRACT

A child's toy is a mechanical hand having at least articulated fingers, and perhaps an articulated thumb, associated with a palm section. A control compartment attached to and extending from the palm section includes fingertip controls which selectively move the articulated fingers. A clip-on special effects box, also operated by fingertip control, may be added to the mechanical hand in order to provide a weapon, sound effect, laser beam, or the like. In the embodiment described herein, the weapon is a set of four claws which may extend from or retract into the box.

18 Claims, 3 Drawing Sheets

TOY MECHANICAL HAND

FIELD OF THE INVENTION

This relates to children's toys and more particularly to toys which provide both physical activity and imaginative play.

BACKGROUND OF THE INVENTION

Designers of toys are challenged to produce a continuous stream of new devices which attract and keep the attention of children, despite the fact that a child inherently has a relatively short attention span. The toy should also stimulate imaginative play that leads to creative thought. Also, it is desirable for such a toy to provide multiple interests so that it fits into different games or play and may be used in different ways. Another consideration is that the toy may teach small muscle coordination. Still, the toy must be safe enough to insure the child's well being and to avoid accidents. Some toys are designed to stimulate active play when the child engages in physical exercise. Therefore, the safety factor is especially important if the toy is a "weapon" or other device which has a potential for destructive power which is used during physically rough play. Here again, safety of the play is of great importance.

Dress-up toys and clothes are timeless attractions to children who can then imagine themselves to be almost anyone of almost any time period. Modern fields of interest to children are robots, space aliens, super heros, and the like. Therefore, an especially attractive toy would be one where the child may dress up at least in part and pretend to be any of these or similar persons.

SUMMARY OF THE INVENTION

Accordingly, an object of the invention is to provide new and improved toys of the described types. In particular, an object is to provide an action toy for inducing physical, but safe, play. Here, an object is to provide a toy which the child may manipulate with his fingers to help develop small muscle coordination.

In keeping with an aspect of the invention, these and other objects are accomplished by a mechanical hand or arm which the child can attach over his own hand or to his forearm. By moving his own fingers, the child may manipulate the mechanical hand almost as if it were his own. Special effects produced by tools, weapons, or the like may be added to or removed from the mechanical hand in order to provide a variety when the child plays with the hand. Exemplary of such an effect is an extension or retraction of claws, the directing of laser beams, or the like.

BRIEF DESCRIPTION OF THE DRAWINGS

A preferred embodiment of the invention is shown in the drawings, in which.

DETAILED DESCRIPTION

Figure 1:
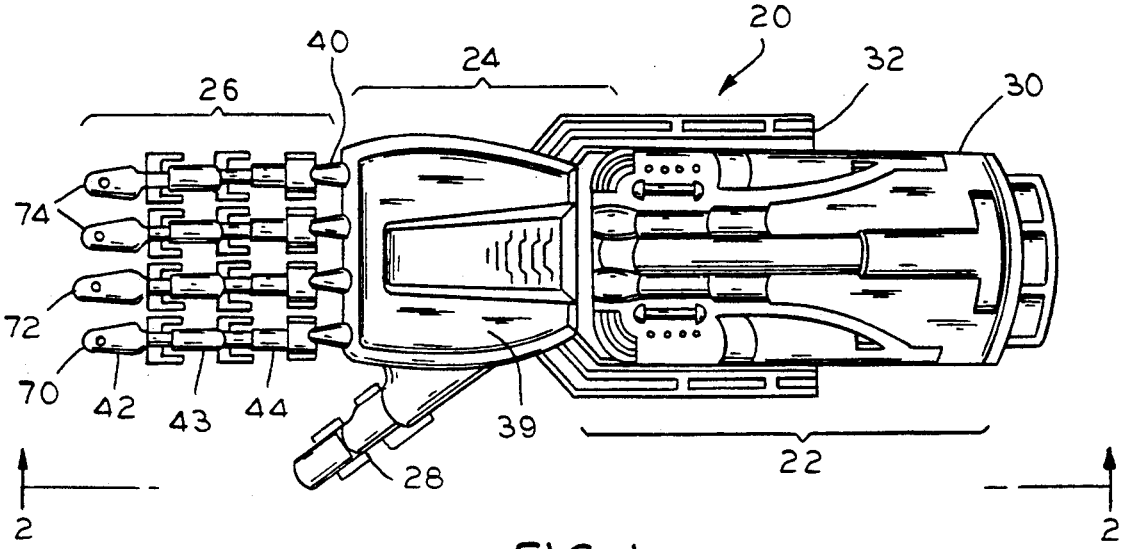
FIG. 1 is a top plan view of a preferred embodiment of an inventive mechanical hand or arm.

FIG. 1 is a top plan view showing a mechanical hand or arm 20 which a child may strap on to his hand or wrist. The mechanical hand includes a control compartment and cover 22 with a hand or palm section 24 having four articulated fingers 26 and thumb 28 extending therefrom. The thumb might be either articulated or a fixed appendage. The control compartment 22 includes controls which are manipulated by a child's fingers and thumb (if an articulated thumb is provided) for clinching the mechanical hand into a fist, or for opening the mechanical hand, or for moving the hand to assume any suitable position between a fist and an open hand. The child may also control the special effects box 39 from within the control compartment 22.

Figure 5:
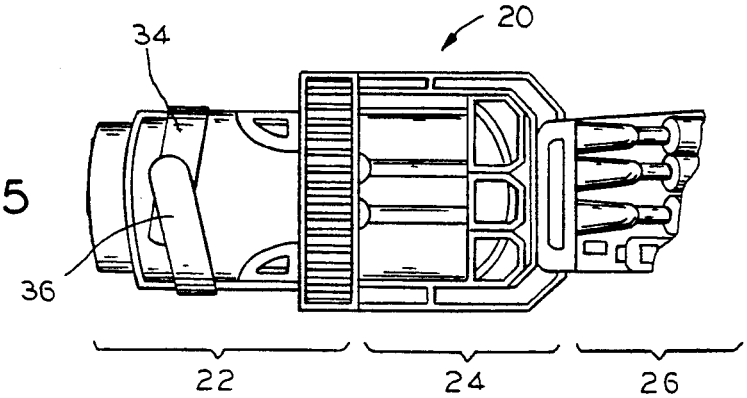
FIG. 5 is a fragmentary plan view of the bottom of the mechanical hand of FIG. 1.

The control compartment 22 has a cover 30 (FIG. 2) hinged to the mechanical palm section 24. A control panel 32 extends from the palm section 24 to provide a means which the child may grip and control the mechanical hand. The child places his hand and fingers on top and his thumb under the control panel 32 and then closes the cover 30 over his hand and wrist. Two straps 34, 36 (FIG. 5) are wrapped around the child's wrist or forearm and then joined together in any suitable manner. While any suitable fastener may be provided to hold together the joined straps 34, 36, a hook and loop fastener, such as that sold under the trademark "Velcro", may be used.

Figure 11:
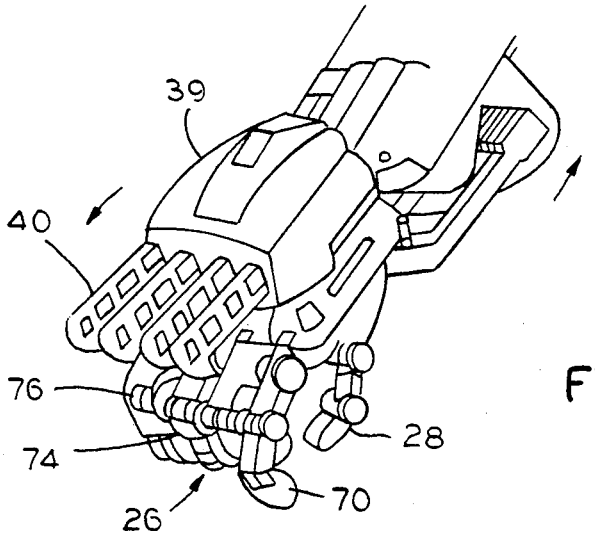
FIG. 11 shows the child's hand encased in the mechanical hand, with the mechanical hand closed and a special effects claw weapon extended.

The child's fingertips fit into rings or triggers 37 (FIGS. 7, 9) formed on slides inside the control compartment 22. By flexing his own individual fingers and thumb, he may control the individual fingers and thumb (if articulated) of the mechanical hand. Thus, by making his own hand into a fist, the child causes the mechanical hand to also make a fist (FIG. 11). By extending his own fingers to make an open hand, the mechanical hand also extends its fingers (FIG. 1) to become an open hand.

Figure 2:
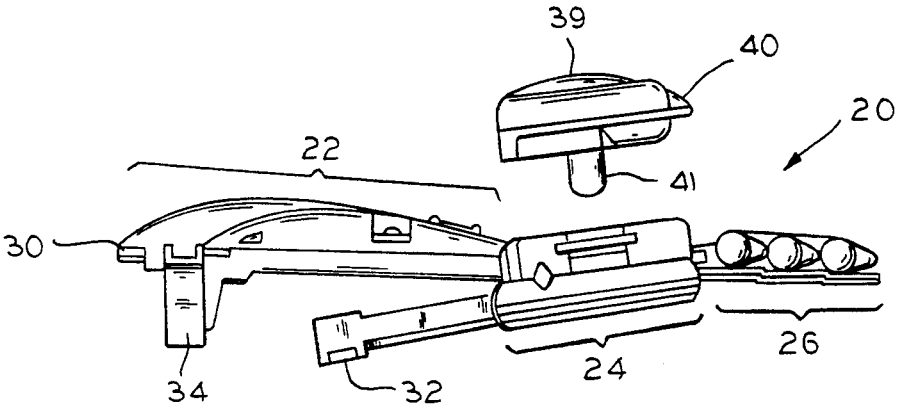
FIG. 2 is a side elevation view taken along line 2—2 of FIG. 1 with an auxiliary add-on special effects box poised for attachment to the mechanical hand.
Figure 3:
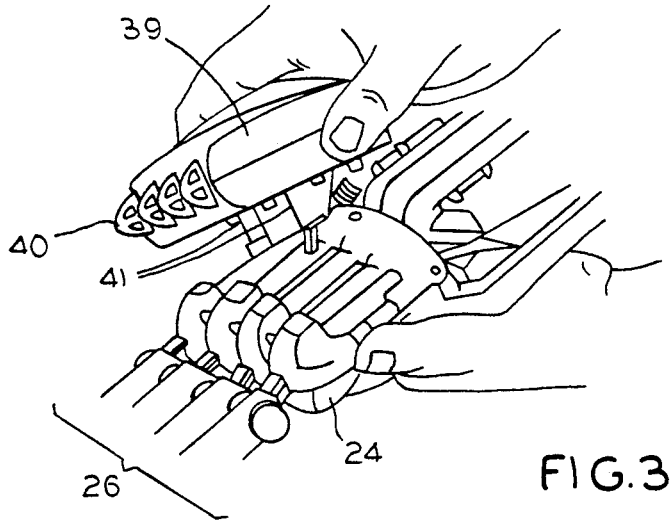
FIG. 3 is a perspective view of a child attaching the special effects box to the back of the hand.
Figure 4:
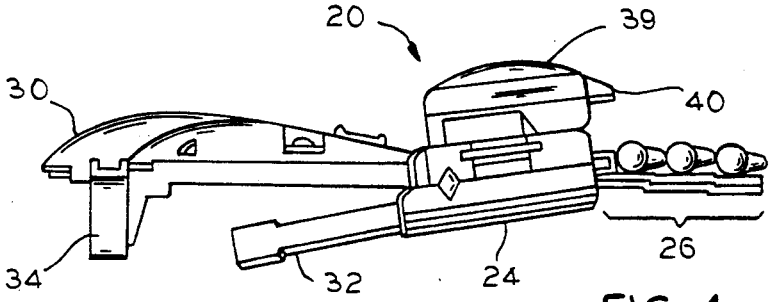
FIG. 4 is a view similar to that of FIG. 2, with the special effects box snapped into place on the back of the mechanical hand.

Any of a number of special effects or weapons or other add-ons may be in a box 39 which may clip onto the mechanical hand (FIG. 2). More particularly, the palm section 24, includes not only mechanisms to articulate the fingers, but also connectors to receive the special effects box 39. In this particular example, the special effects box 39 includes four claws 40 which may be extended or retracted by the child.

A connector-actuator 41 depends from the bottom of the box 39. This connector may be pressed into mating connectors formed on the back of the palm section 24. Once clipped on, four claws 40 operate responsive to the child's manipulation of at least one of his own fingertips. In its simplest form, the claws 40 extend simultaneously with a clinching of the fist. In a more sophisticated form, the child may be given a separate control in the control compartment for the claws.

Many other special effects boxes may be provided for alternative attachment to the hand. For example, a "laser beam" in box 39 may shoot the enemy, at the child's command. A sound device may be added to provide audible "attack" sounds or digitized voice commands. Still other special effects may be provided.

Figure 7:
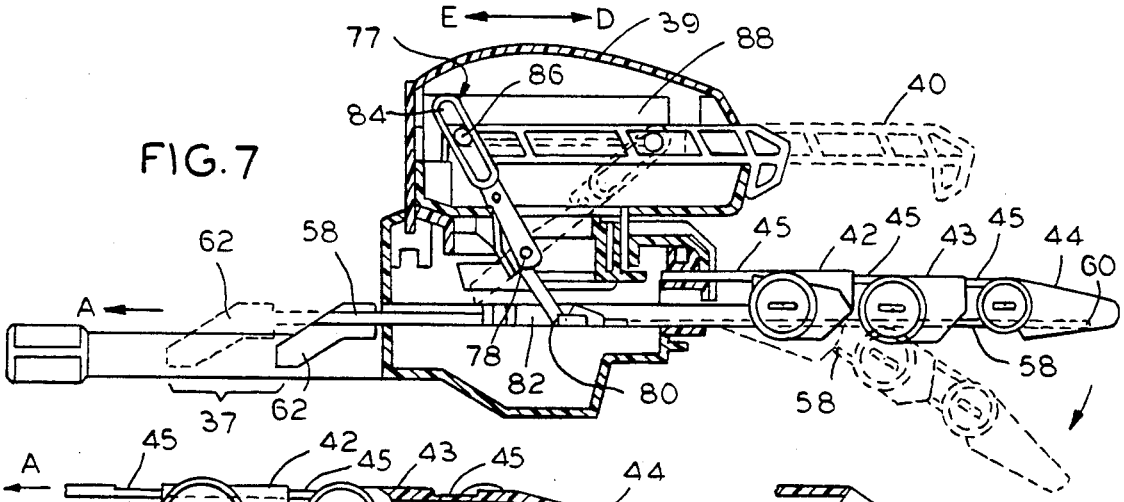
FIG. 7 is a cross-section of the hand showing a trigger and mechanism for articulating the mechanical fingers and for extending and retracting a claw in the special effects box in response to a fingertip control by a child.
Figure 8A:
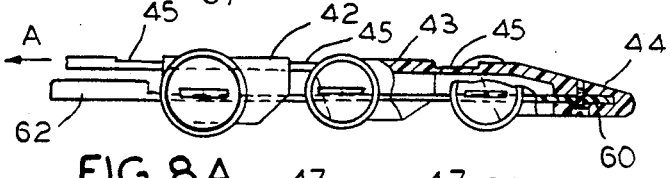
FIG. 8A shows hinged joints in an embodiment of an articulated mechanical finger.
Figure 8B:
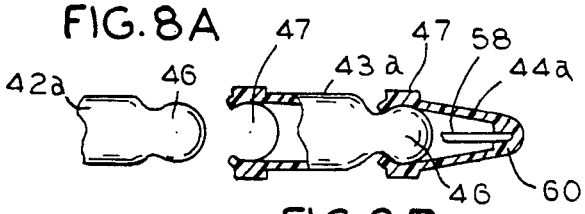
FIG. 8B is a showing of joints and segments in another embodiment of an articulated mechanical finger.
Figure 6:
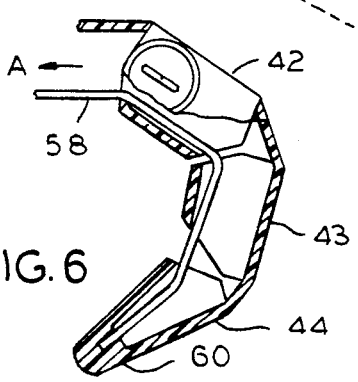
FIG. 6 is a cross-section view of a single articulated mechanical finger.

Each of the thumb 28 and fingers 26 (FIGS. 6–8) include a plurality of segments 42, 43, 44 which are hinged together in any suitable manner. More particularly, in a preferred embodiment, (FIG. 8A) the entire finger may be made in a low cost way as a single, integral, molded part, if desired. There are three segments 42, 43, 44 which correspond to the three segments of a human finger. A strip of plastic 45 connects each of the finger segments to its neighboring segment, preferably near the top thereof. Each of these strips 45 may flex and act as a hinge which may bend as shown in FIG. 6. Or the strips 45 may be straight so that the finger is straight, as shown in FIG. 7. The plastic memory of the strips 45 is such that the finger is normally straight, unless pulled in by a strap 58.

In another embodiment (FIG. 8B), each of the segments **42*a*, 43*a*, 44*a* has projecting parts 46 on one end which snap over mating parts on the other end. Preferably, the segments 42–44** are molded plastic parts with a shape which simply snaps together, with no need for a hinge pin. However, it should be understood that the segments may also be held together by a hinge pin or the like.

Each mechanical finger segment 42–44 is hollow and contains a window at each end so that a sliding member in the form of a strap-like mechanism 58 may extend throughout the finger and attach at 60 to the inside of the finger tip segment 44. Attached to the palm end of the mechanism 58 is a ring or dished trigger 62 for receiving the child's fingertip. Trigger 62 is part of a sliding assembly. When the child's fingertip pulls trigger 62 in direction A (FIGS. 6, 7), the mechanical finger curls. When the child pushes trigger 62 in the opposite direction, the finger straightens.

Figure 9:
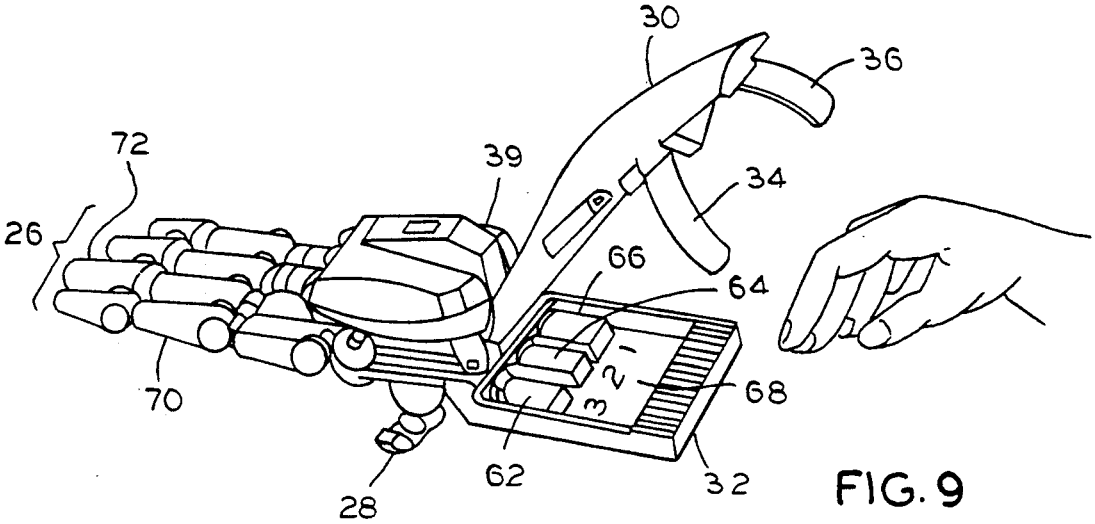
FIG. 9 shows, in perspective, a child's hand about to have the mechanical hand installed around it.

As seen in FIG. 9, three triggers 62, 64, 66 are positioned side by side within a box 68 formed in the control panel 32. The inside dimensions of box 68 define how far forward or backward the triggers 62–66 may slide in order to open the mechanical hand or to clinch it in a fist. In one embodiment, the trigger 62 controls the index finger 70 of the mechanical hand. The trigger 64 controls the middle finger 72 of the mechanical hand. The trigger 66 controls the mechanical ring and little fingers, 74, 76. If it is articulated, the mechanical thumb 28 may be controlled by the child's thumb in a similar manner.

Figure 10:
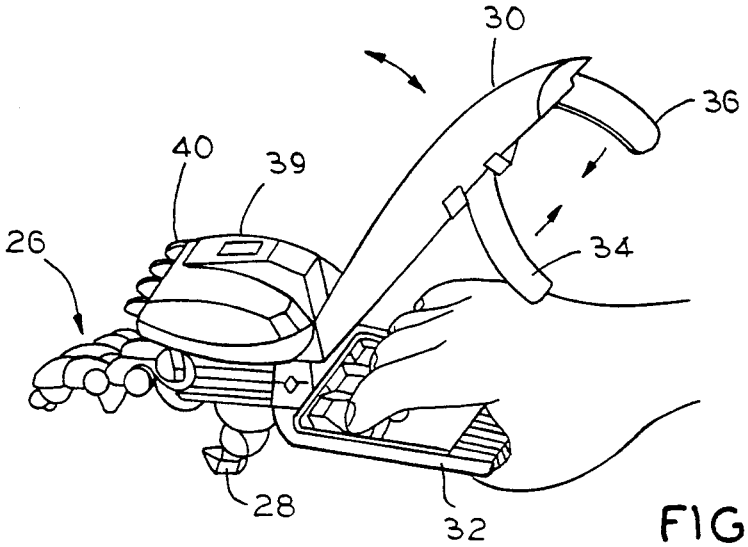
FIG. 10 shows the child's hand gripping the mechanical hand, prior to a closing of a cover plate and securing of straps around the child's wrist or forearm.

The operation of the inventive mechanical hand is shown in FIGS. 9–11. The child grips the control panel 32 by placing his fingertips in the rings or dished areas of triggers 62–66 and his thumb under the control panel 32.

While the child is so holding the control panel 32, cover 30 is closed and the straps 34, 36 (FIG. 5) are secured around the child's wrist or forearm. When the child closes his hand, his fingertips and thumb pull the rings or dished triggers while he closes his own fist to, in turn, close the fingers and thumb of the mechanical hand (FIG. 11). The child's fingertips pull the dished triggers. When the child's fingertips and push the rings or dished triggers, the mechanical fingers straighten. In one embodiment, the trigger 62 controls both the forefinger 70 and also the extension and retraction of the claws 40 in special effects box 39. If box 39 (FIG. 7) contains an electrical device such as a laser gun or a sounding device, a push button may be located in or under the control panel 32 to be activated by a finger or thumb.

In greater detail, the special effects control box 39 includes a lever arm 77 which is pivoted at 78. The bottom 80 of the lever arm fits into a window 82 in the strap like mechanism 58. The opposite end of lever arm 77 includes a lost motion linkage 84 which enables the lever arm to engage a pin 86 on a slide 88. As the lever arm 77 swings back and forth, the slide 88 moves back and forth in direction E,D. This causes the claws 40 to move out to an extended position (shown by dashed lines) or to move back (shown by solid lines), in response to a movement of the trigger 62.

Those who are skilled in the art will readily perceive how to modify the invention. Therefore, the appended claims are to be construed to cover all equivalent structures which fall within the true scope and spirit of the invention.

We claim:

1. A toy comprising a mechanical hand having a control compartment attached to a palm section with a plurality of adjacent articulated mechanical fingers and an opposed thumb attached thereto, means associated with said control compartment for attaching said mechanical hand to a child's arm with at least part of the child's hand enclosed in the control compartment, and a plurality of adjacent slides, each attached at a forward end to a respective mechanical finger and each mounting a finger engageable trigger at a rearward end in said control compartment, said triggers being positioned in laterally fixed relation to each other so as to be engaged by the child's fingers for articulating at least said mechanical fingers responsive to the child manipulating his fingers.

2. The toy of claim 1 wherein said triggers for articulating said fingers comprise a plurality of sliding members, each of said sliding members having thereon means for receiving the child's fingertips, said sliding members being selectively operated by individually associated ones of said child's fingers.

3. The toy of claim 1 wherein said means for attaching said mechanical hand to said child's arm comprises a cover associated with said control compartment, and means for securing said cover over said compartment with said child's hand in said compartment.

4. The toy of claim 3 wherein said securing means includes at least one strap associated with said cover, and a hook and loop fastener associated with said strap for securing said cover in place with said child's hand inside said cover.

5. The toy of claim 1 and special effects means, means for releasably attaching said special effects means to said mechanical hand, and means in said control compartment for selectively operating said special effects means independent of operating said articulated fingers and responsive to a control function performed by the hand of the child having the mechanical hand attached thereto.

6. The toy of claim 1 wherein each of said articulated mechanical fingers comprises an integral molded plastic unit having tube-like segments joined at one edge by strips which act as hinges between the segments, and a strap passing through said tube-like segments, one end of said strap being joined to a finger tip of the articulated mechanical finger, said triggers being affixed to the other end of said strap.

7. The toy of claim 6 wherein said strips have a plastic memory which causes the finger to straighten if said strap is not pulled.

8. A toy comprising a mechanical hand having:

a control compartment attached to a palm section with articulated mechanical fingers and a thumb attached thereto;

means associated with said control compartment for attaching said mechanical hand to a child's arm with at least part of the child's hand enclosed in the control compartment;

trigger means in said control compartment, said trigger means being positioned to be engaged by the child's fingers for articulating at least said mechanical fingers responsive to the child manipulating his fingers;

special effects means;

means for releasably attaching said special effects means to said mechanical hand;

means in said control compartment for selectively operating said special effects means responsive to a control function performed by the hand of the child having the mechanical hand attached thereto;

said special effects means including a box with simulated claws therein, said special effects means adapted to allow extension of said claws from and a retraction of said claws into a box; and means responsive to a child's manipulation of said means in said control compartment by said child for extending and retracting said simulated claws.

9. The toy of claim 8 and means in said box and said mechanical hand responsive to said child's manipulation for transferring forces between said mechanical hand and said box.

10. The toy of claim 9 wherein said force transferring means comprises a pivoted lever having a lost motion connection to said claws.

11. A mechanical hand comprising a plurality of adjacent articulated mechanical fingers attached to one end of a palm section of said hand with a control section extending from an opposite end of said palm, a plurality of side by side slide members in said control section, each of said slide members having a moveable trigger arranged in a laterally fixed relationship to each other for receiving individually associated fingers on a person's hand by which the person's fingers may move the slide members at least one of said slides featuring means to activate a special effects means mounted upon said mechanical hand, and means associated with each of said slide members for curling or uncurling at least one of said articulated mechanical fingers in response to said movement of said slide members.

12. The mechanical hand of claim 11 wherein each of said articulated mechanical fingers has a plurality of segments hingedly attached to each other, said trigger means being fingertip receiving sections on said slide members in the form of rings or dished sections which enable fingertips of said person's hands to move said slides, said articulated mechanical fingers having a passageway extending through each of said segments, and said means for curling and uncurling said fingers being strap-like members extending from said slides through said passageways in said segments to control the position of said segments.

13. The toy of claim 11 wherein each of said articulated mechanical fingers comprises an integral molded plastic unit having tube-like segments joined at one edge by strips which act as hinges between the segments, and a strap passing through said tube-like segments, one end of said strap being joined to a finger tip of the articulated mechanical finger, said triggers being affixed to the other end of said strap.

14. The toy of claim 13 wherein said strips have a plastic memory which causes the finger to straighten if said strap is not pulled.

15. A mechanical hand comprising articulated mechanical fingers attached to one end of a palm section of said hand with a control section extending from an opposite end of said palm, a plurality of side by side slide members in said control section, each of said slide members having trigger means for receiving individually associated fingers on a person's hand by which the person's fingers may move the slides, means associated with each of said slides for curling or uncurling at least one of said articulated mechanical fingers in response to said movement of said slides, special effects means, connector means on said special effects means and on said mechanical hand whereby said special effects means may be added to or removed form said mechanical hand, and means associated with said connector means for activating said special effect means in response to a manipulation of said person's fingers.

16. The mechanical hand of claim 15 wherein said special effects means comprises a plurality of simulated claws, and said actuating means associated with said connector comprises means operated by said strap-like member for extending and retracting said claws.

17. The mechanical hand of claim 16 and means responsive to at least one of said slides for operating said actuating means which extends and retracts said claws.

18. A mechanical hand comprising:

articulated mechanical fingers attached to one end of a palm section of said hand with a control section extending from an opposite end of said palm;

a plurality of side-by-side slide members in said control section, each of said slide members having trigger means for receiving individually associated fingers on a person's hand by which the person's fingers may move the slide members;

means associated with each of said slides for curling or uncurling at least one of said articulated mechanical fingers in response to said movement of said slide members;

said articulated mechanical fingers having a plurality of segments hingedly attached to each other;

said trigger means being fingertip receiving sections on said slide members in the form of rings or dished sections which enable fingertips of said person's hands to move said slides;

said mechanical articulated fingers having a passageway extending through each of said segments;

said means for curling and uncurling said fingers being strap-like members extending from said slide members through said passgeways in said segments to control the position of said segments;

said mechanical hand having a first slide under the index finger of said person's hand which controls an articulated index finger of said mechanical hand, a second slide under the middle finger of said person's hand which controls an articulated middle finger of said mechanical hand, and a third slide under the ring finger of said person's hand which controls both the ring finger and the little finger of said mechanical hand.

* * * * *